US007841286B1

(12) United States Patent
Bochenski

(10) Patent No.: US 7,841,286 B1
(45) Date of Patent: Nov. 30, 2010

(54) AUTOMATIC BILGE PUMP SYSTEM

(76) Inventor: Sebastian Bochenski, 4939 Floramar Ter., Apt. 402, New Port Richey, FL (US) 34652

( * ) Notice: Subject to any disclaimer, the term of this patent is extended or adjusted under 35 U.S.C. 154(b) by 22 days.

(21) Appl. No.: 12/383,508

(22) Filed: Mar. 25, 2009

(51) Int. Cl.
*B63B 13/00* (2006.01)

(52) U.S. Cl. ..... 114/183 R

(58) Field of Classification Search ..... 114/183 R
See application file for complete search history.

(56) References Cited

U.S. PATENT DOCUMENTS 4,468,546 A * 8/1984 Jones ..... 200/84 B
6,447,261 B1 * 9/2002 McCook ..... 417/234
7,327,286 B2 2/2008 Knoska
2003/0015642 A1 * 1/2003 Polzin et al. ..... 248/674
2006/0073040 A1 * 4/2006 Metzger et al. ..... 417/423.1

* cited by examiner

*Primary Examiner*—Stephen Avila

(57) ABSTRACT

A container has a base and a cover. A housing is provided within the container. The housing has an upper extend and a water passageway for the upward flow of water. A hose extends laterally from the upper extent of the housing. A pump in the housing moves water through the housing and the hose. A control assembly controls the operation of the pump.

4 Claims, 3 Drawing Sheets

FIG 1
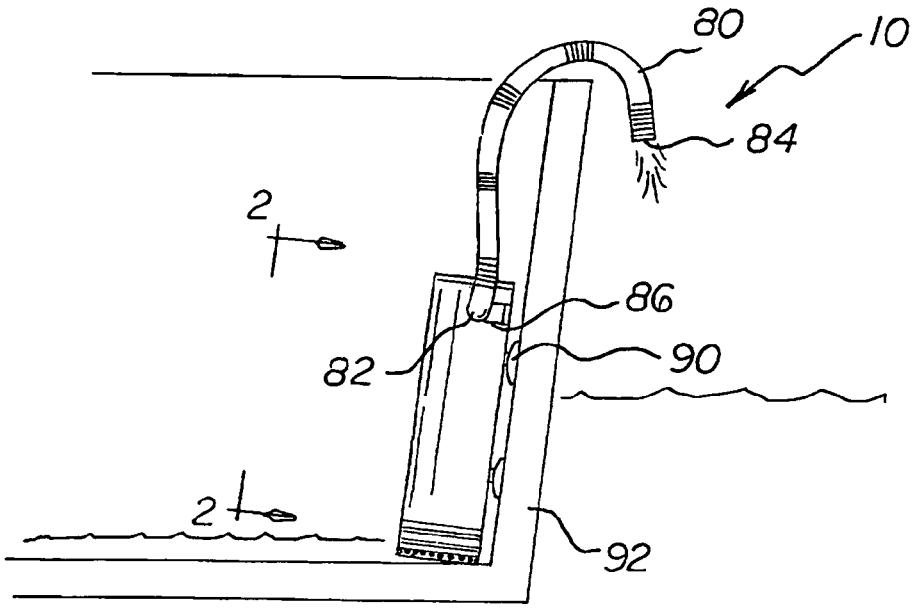
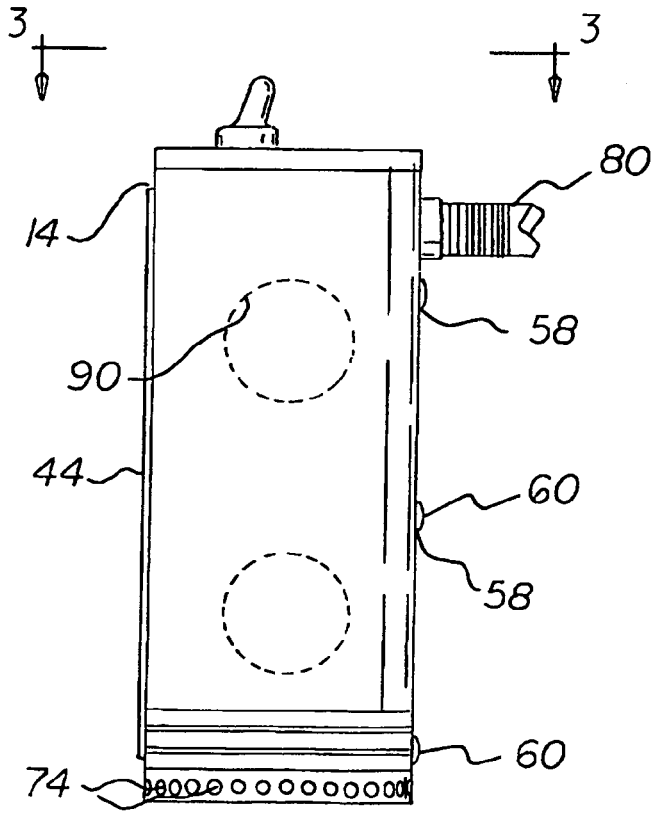
FIG 2

AUTOMATIC BILGE PUMP SYSTEM

BACKGROUND OF THE INVENTION

1. Field of the Invention

The present invention relates to an automatic bilge pump system and more particularly pertains to removing unwanted water from a boat through automatically activating and inactivating a low voltage pump, the pumping being done in a convenient, reliable and economical manner.

2. Description of the Prior Art

The use of pump systems of known designs and configurations is known in the prior art. More specifically, pump systems of known designs and configurations previously devised and utilized for the purpose of pumping water through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,468,546 issued Aug. 28, 1984 to Jones relates to Bilge Pump Activator Switch. U.S. Pat. No. 6,447,261 issued Sep. 10, 2002 to McCook relates to a Portable Bilge Pump Assembly. Lastly, U.S. Pat. No. 7,327,286 issued Feb. 5, 2008 to Knoska relates to a Marine Vessel Monitoring System.

While these devices fulfill their respective, particular objectives and requirements, the aforementioned patents do not describe an automatic bilge pump system that allows for removing unwanted water from a boat through automatically activating and inactivating a low voltage pump, the pumping being done in a convenient, reliable and economical manner.

In this respect, the automatic bilge pump system according to the present invention substantially departs from the conventional concepts and designs of the prior art, and in doing so provides an apparatus primarily developed for the purpose of removing unwanted water from a boat through automatically activating and inactivating a low voltage pump, the pumping being done in a convenient, reliable and economical manner.

Therefore, it can be appreciated that there exists a continuing need for a new and improved automatic bilge pump system which can be used for removing unwanted water from a boat through automatically activating and inactivating a low voltage pump, the pumping being done in a convenient, reliable and economical manner. In this regard, the present invention substantially fulfills this need.

SUMMARY OF THE INVENTION

In view of the foregoing disadvantages inherent in the known types of pump systems of known designs and configurations now present in the prior art, the present invention provides an improved automatic bilge pump system. As such, the general purpose of the present invention, which will be described subsequently in greater detail, is to provide a new and improved automatic bilge pump system and method which has all the advantages of the prior art and none of the disadvantages.

To attain this, the present invention essentially comprises an automatic bilge pump system. First provided is a container. The container has a rectangular, vertically oriented base. The container has interior and exterior surfaces. The base has first and second side edges. The base has upper and lower edges. The container also has a semi-cylindrical cover. The cover has interior and exterior surfaces. The cover has first and second side edges. The cover also has upper and lower edges. A hinge is provided. The hinge pivotally couples the first side edge of the cover to the first side edge of the base. In this manner the base may pivot between a closed position and an open position. In the closed position the second side edge of the cover is in contact with the second side edge of the base. In the open position the second side edge of the cover is out of contact with the second side edge of the base.

Three semi-circular plates are provided. The plates extend interiorly from the base. The plates include an upper plate. The upper plate is provided at the upper edge of the base. The plates include a lower plate. The lower plate is provided at the lower edge of the base. The plates further include an intermediate plate. The intermediate plate is provided between the upper and lower plates. The plates are adapted to be contacted by the cover when the cover is in the closed position. The base and cover and plates are fabricated of polyvinyl chloride.

A plurality of threaded apertures is provided next. The threaded apertures are provided in the second side edge of the base. A plurality of unthreaded apertures is provided. The unthreaded apertures are provided in the cover adjacent to the second side edge of the cover. A plurality of screws is also provided. The screws are positionable through the unthreaded apertures of the cover and the threaded apertures of the base. In this manner the cover and base may be coupled.

A generally cylindrical, hollow housing is provided. The housing has an enlarged upper extent. The upper extent is provided adjacent to the upper plate. The housing has an enlarged lower extent. The lower extent is provided adjacent to the lower plate. The housing further includes a central extent. The central extent passes through and is supported by the intermediate plate.

Lower apertures are provided. The lower apertures are provided in the cover adjacent to its lower edge and in the lower plate. In this manner a water passageway is formed. An axial opening is provided. The axial opening is provided in the lower extent of the housing. A lateral opening is provided. The lateral opening is provided in the upper extent of the housing. The water passageway also includes a flexible hose. The flexible hose has an input end. The input end is attached to the lateral opening in the housing. The flexible hose has an output end 84. A recess 86 is provided. The recess is provided in the second side edge of the cover. In this manner the hose is accommodated.

Also provided is a plurality of suction cups. A transom of a boat is provided. The suction cups are provided on the exterior surface of the base. In this manner the system is coupled to the transom of a boat to be pumped.

Further provided is a self priming pump. The self priming pump is provided in the upper extent of the housing. In this manner water is moved through the passageway from inside the boat to exterior of the boat.

Provided last is a control assembly. The control assembly includes a water-controlled switch. The water-controlled switch is coupled to the interior surface of the base adjacent to the lower edge of the base. The water-controlled switch includes a float. The float is adapted to rise in the presence of water. In this manner the pump is activated. The float is further adapted to lower in the absence of water. In this manner the pump is inactivated. The control assembly also includes a battery pack. The battery back includes two 1.5 volt batteries. In this manner the pump is powered. The control assembly also includes an operator-controlled three-way switch. Electrical wires couple the three-way switch with the batteries and the pump and the water-controlled switch. In this manner when the three-way switch is in a first position the pump is activated. Also in this manner when the three-way switch is in a second position the pump is inactivated. Further in this manner when the three-way switch is in a third position the pump is activated and inactivated in response to the rising and falling of the float.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic bilge pump system which has all of the advantages of the prior art pump systems of known designs and configurations and none of the disadvantages.

It is another object of the present invention to provide a new and improved automatic bilge pump system which may be easily and efficiently manufactured and marketed.

It is further object of the present invention to provide a new and improved automatic bilge pump system which is of durable and reliable constructions.

An even further object of the present invention is to provide a new and improved automatic bilge pump system which is susceptible of a low cost of manufacture with regard to both materials and labor, and which accordingly is then susceptible of low prices of sale to the consuming public, thereby making such automatic bilge pump system economically available to the buying public.

Even still another object of the present invention is to provide an automatic bilge pump system for removing unwanted water from a boat through automatically activating and inactivating a low voltage pump, the pumping being done in a convenient, reliable and economical manner.

Lastly, it is an object of the present invention to provide a new and improved automatic bilge pump system. A container has a base and a cover. A housing is provided within the container. The housing has an upper extend and a water passageway for the upward flow of water. A hose extends laterally from the upper extent of the housing. A pump in the housing moves water through the housing and the hose. A control assembly controls the operation of the pump.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an automatic bilge pump system constructed in accordance with the principles of the present invention.

FIG. 2 is a front elevational view of the system taken along line 2-2 of FIG. 1.

The same reference numerals refer to the same parts throughout the various Figures.

DESCRIPTION OF THE PREFERRED EMBODIMENT

Figure 3:
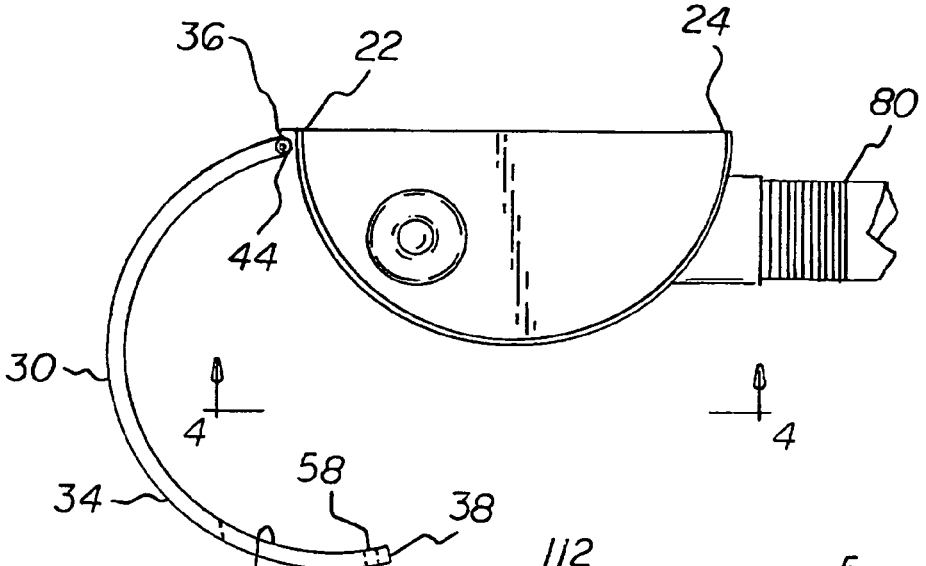
FIG. 3 is a plan view of the system taken along line 3-3 of FIG. 2.
Figure 4:
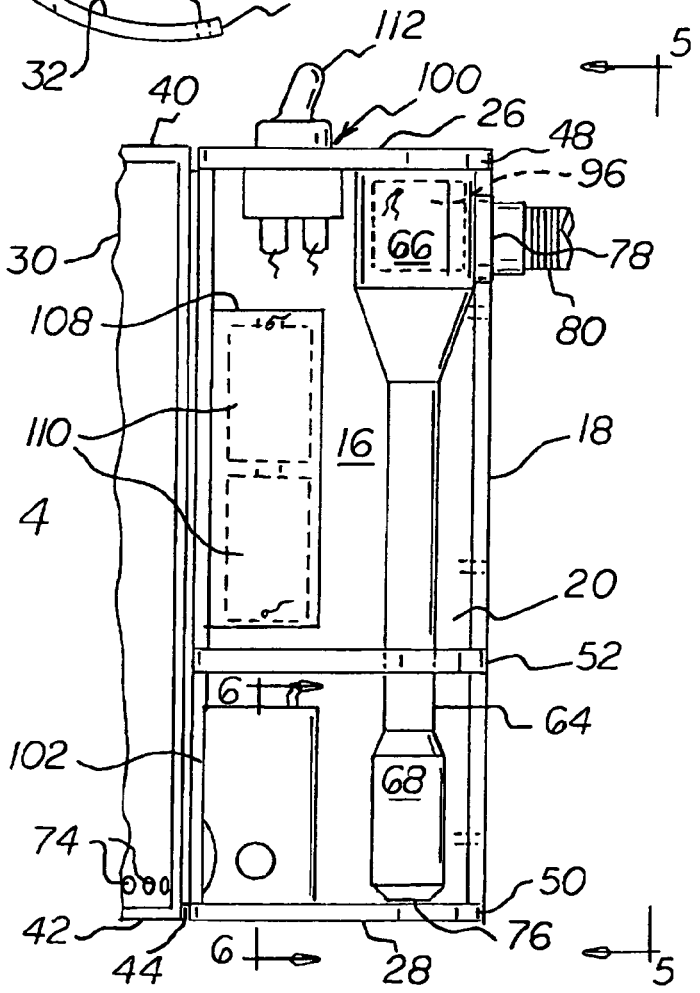
FIG. 4 is a front elevational view of the system taken along line 4-4 of FIG. 3 with the cover open.
Figure 5:
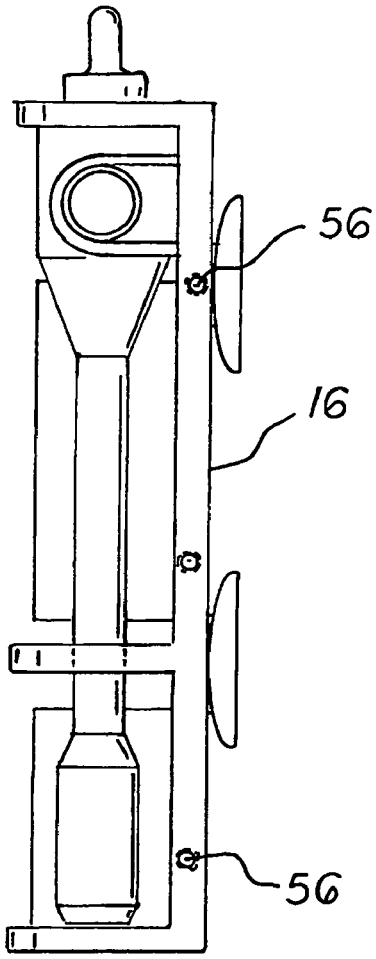
FIG. 5 is a side elevational view of the system taken along line 5-5 of FIG. 4 with the cover open.
Figure 6:
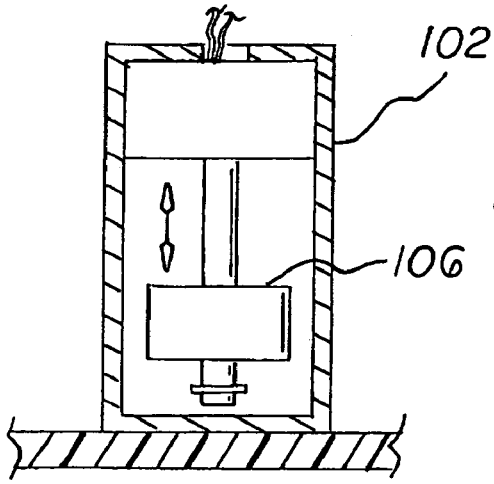
FIG. 6 is a cross sectional view of the float valve taken along line 6-6 of FIG. 4.

With reference now to the drawings, and in particular to FIG. 1 thereof, the preferred embodiment of the new and improved automatic bilge pump system embodying the principles and concepts of the present invention and generally designated by the reference numeral 10 will be described.

The present invention, the automatic bilge pump system 10 is comprised of a plurality of components. Such components in their broadest context include a container, a housing, a hose, a pump and control assembly. Such components are individually configured and correlated with respect to each other so as to attain the desired objective.

First provided is a container 14. The container has a rectangular, vertically oriented base 16. The container has interior and exterior surfaces 18, 20. The base has first and second side edges 22, 24. The base has upper and lower edges 26, 28. The container also has a semi-cylindrical cover 30. The cover has interior and exterior surfaces 32, 34. The cover has first and second side edges 36, 38. The cover also has upper and lower edges 40, 42. A hinge 44 is provided. The hinge pivotally couples the first side edge of the cover to the first side edge of the base. In this manner the base may pivot between a closed position and an open position. In the closed position the second side edge of the cover is in contact with the second side edge of the base. In the open position the second side edge of the cover is out of contact with the second side edge of the base.

Three semi-circular plates are provided. The plates extend interiorly from the base. The plates include an upper plate 48. The upper plate is provided at the upper edge of the base. The plates include a lower plate 50. The lower plate is provided at the lower edge of the base. The plates further include an intermediate plate 52. The intermediate plate is provided between the upper and lower plates. The plates are adapted to be contacted by the cover when the cover is in the closed position. The base and cover and plates are fabricated of polyvinyl chloride.

A plurality of threaded apertures 56 is provided next. The threaded apertures are provided in the second side edge of the base. A plurality of unthreaded apertures 58 is provided. The unthreaded apertures are provided in the cover adjacent to the second side edge of the cover. A plurality of screws 60 is also provided. The screws are positionable through the unthreaded apertures of the cover and the threaded apertures of the base. In this manner the cover and base may be coupled.

A generally cylindrical, hollow housing 64 is provided. The housing has an enlarged upper extent 66. The upper extent is provided adjacent to the upper plate. The housing has an enlarged lower extent 68. The lower extent is provided adjacent to the lower plate. The housing further includes a central extent 70. The central extent passes through and is supported by the intermediate plate.

Lower apertures 74 are provided. The lower apertures are provided in the cover adjacent to its lower edge and in the lower plate. In this manner a water passageway is formed. An axial opening 76 is provided. The axial opening is provided in the lower extent of the housing. A lateral opening 78 is provided. The lateral opening is provided in the upper extent of the housing. The water passageway also includes a flexible hose 80. The flexible hose has an input end 82. The input end is attached to the lateral opening in the housing. The flexible hose has an output end 84. A recess 86 is provided. The recess is provided in the second side edge of the cover. In this manner the hose is accommodated.

Also provided is a plurality of suction cups 90. A transom 92 of a boat is provided. The suction cups are provided on the exterior surface of the base. In this manner the system is coupled to the transom of a boat to be pumped. In FIG. 1, the rear of the boat is shown. The system of the present invention is adapted for use with essentially any conventional boat.

Further provided is a self priming pump 96. The self priming pump is provided in the upper extent of the housing. In this manner water is moved through the passageway from inside the boat to exterior of the boat.

Provided last is a control assembly 100. The control assembly includes a water-controlled switch 102. The water-controlled switch is coupled to the interior surface of the base adjacent to the lower edge of the base. The water-controlled switch includes a float 106. The float is adapted to rise in the presence of water. In this manner the pump is activated. The float is further adapted to lower in the absence of water. In this manner the pump is inactivated. The control assembly also includes a battery pack 108. The battery back includes two 1.5 volt batteries 110. In this manner the pump is powered. The control assembly also includes an operator-controlled three-way switch 112. Electrical wires couple the three-way switch with the batteries and the pump and the water-controlled switch. In this manner when the three-way switch is in a first position the pump is activated. Also in this manner when the three-way switch is in a second position the pump is inactivated. Further in this manner when the three-way switch is in a third position the pump is activated and inactivated in response to the rising and falling of the float.

One further feature and benefit of the present invention is safety, particularly for small vessels. In the event that a minor leak begins, water entering the vessel will be pumped away and drained essentially immediately rather that waiting for excessive water entering the vessel and causing greater harm and danger. With the three-way switch activated, the users of the vessel have no need to continually check for water leaks.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automatic bilge pump system comprising:

a container having a base and a cover;

a housing within the container, the housing having an upper extend and a water passageway for the upward flow of water;

a hose extending laterally from the upper extent of the housing;

a pump in the housing for moving water through the housing and the hose; and a control assembly for controlling the operation of the pump, the control assembly including a water-controlled switch and a float and at least one battery for powering the pump, an operator-controlled switch coupling the operator-controlled switch with the battery and the pump and the water-controlled switch whereby when the operator-controlled switch is in a first position the pump is activated, and whereby when the operator-controlled switch is in a Second position the pump is inactivated, and whereby when the operator-controlled switch is in a third position the pump is activated and inactivated in response to the rising and falling of the float.

2. The system as set forth in claim 1 wherein the at least one battery is a battery pack with two 1.5 volt batteries.

3. The system as set forth in claim 1 and further including a plurality of suction cups on the base of the container for removably coupling the system to a transom of a boat whereby the system is adapted to operate as a bilge pump.

4. An automatic bilge pump system for removing unwanted water from a boat through automatically activating and inactivating a low voltage pump, the system comprising, in combination:

a container having a rectangular, vertically oriented base with interior and exterior surfaces, the base having first and second side edges and upper and lower edges, the container also having a semi-cylindrical cover with interior and exterior surfaces, the cover having first and second side edges and upper and lower edges, a hinge pivotally coupling the first side edge of the cover to the first side edge of the base for pivoting the base between a closed position with the second side edge of the cover in contact with the second side edge of the base and an open position with the second side edge of the cover out of contact with the second side edge of the base;

three semi-circular plates extending interiorly from the base, the plates including an upper plate at the upper edge of the base, a lower plate at the lower edge of the base and an intermediate plate between the upper and lower plates, the plates adapted to be contacted by the cover when the cover is in the closed position, the base and cover and plates being fabricated of polyvinyl chloride;

a plurality of threaded apertures in the second side edge of the base and a plurality of unthreaded apertures in the cover adjacent to the second side edge of the cover and a plurality of screws positionable through the unthreaded apertures of the cover and the threaded apertures of the base for coupling purposes;

a generally cylindrical, hollow housing with an enlarged upper extent adjacent to the upper plate and an enlarged lower extent adjacent to the lower plate and a central extent passing through and supported by the intermediate plate;

a water passageway formed by lower apertures in the cover adjacent to its lower edge and in the lower plate, an axial opening in the lower extent of the housing, and a lateral opening in the upper extent of the housing, the water passageway also including a flexible hose having an input end attached to the lateral opening in the housing and an output end, a recess in the second side edge of the cover for accommodating the hose;

a plurality of suction cups on the exterior surface of the base for coupling the system to a transom of a boat to be pumped;

a self priming pump in the upper extent of the housing for moving water through the passageway from inside the boat to exterior of the boat; and a control assembly including a water-controlled switch coupled to the interior surface of the base adjacent to the lower edge of the base, the water-controlled switch including a float adapted to rise in the presence of water to activate the pump and to lower in the absence of water to inactivate the pump, the control assembly also including a battery pack with two 1.5 volt batteries for powering the pump, the control assembly also including an operator-controlled three-way switch with electrical wires coupling the three-way switch with the batteries and the pump and the water-controlled switch whereby when the three-way switch is in a first position the pump is activated, and whereby when the three-way switch is in a second position the pump is inactivated, and whereby when the three-way switch is in a third position the pump is activated and inactivated in response to the rising and falling of the float.

* * * * *